US006637472B2

(12) United States Patent
Camacho et al.

(10) Patent No.: US 6,637,472 B2
(45) Date of Patent: Oct. 28, 2003

(54) COOLANT TRANSFER MACHINE FOR AUTOMOTIVE VEHICLE & METHOD

(75) Inventors: Michael J. Camacho, Rancho Cucamonga, CA (US); Eric A Berg, Tarzana, CA (US); Russell A. Lindquist, Covina, CA (US)

(73) Assignee: Moc Products Company, Inc., Pacoima, CA (US)

( * ) Notice: Subject to any disclaimer, the term of this patent is extended or adjusted under 35 U.S.C. 154(b) by 0 days.

(21) Appl. No.: 10/140,047

(22) Filed: May 7, 2002

(65) Prior Publication Data

US 2002/0166604 A1 Nov. 14, 2002

Related U.S. Application Data

(60) Provisional application No. 60/289,483, filed on May 8, 2001.

(51) Int. Cl.[7] ..... B65B 3/04

(52) U.S. Cl. ..... 141/98; 141/1; 141/7; 141/65; 141/67; 165/95; 184/1.5; 134/169 A

(58) Field of Search ..... 141/1, 4, 5, 7, 141/59, 65, 67, 91, 92, 98; 165/95; 184/1.5, 105.1, 6.4, 6.12, 108; 134/169 A, 169 C, 166 C; 73/37, 40, 45.8, 49.2, 49.7

(56) References Cited

U.S. PATENT DOCUMENTS

| | | | | | |
|---|---|---|---|---|---|
| 3,409,218 | A | * | 11/1968 | Moyer | 237/12.3 B |
| 4,782,689 | A | | 11/1988 | DeRome | |
| 4,888,980 | A | | 12/1989 | DeRome | |
| 5,318,700 | A | | 6/1994 | Dixon et al. | |
| 5,370,160 | A | | 12/1994 | Parker | |
| 5,472,064 | A | | 12/1995 | Viken | |
| 5,573,045 | A | | 11/1996 | Akazawa | |
| 5,615,716 | A | | 4/1997 | Akazawa | |
| 5,649,574 | A | * | 7/1997 | Turcotte et al. | 141/67 |
| 5,681,456 | A | * | 10/1997 | Delport | 210/167 |
| 5,806,629 | A | | 9/1998 | Dixon et al. | |
| 5,853,068 | A | | 12/1998 | Dixon et al. | |
| 6,112,855 | A | | 9/2000 | Camacho et al. | |
| 6,131,701 | A | * | 10/2000 | Camacho et al. | 184/1.5 |
| 6,135,136 | A | | 10/2000 | Klamm | |
| 6,152,193 | A | | 11/2000 | Klamm | |
| 6,161,566 | A | | 12/2000 | Klamm | |
| 6,165,567 | A | | 12/2000 | Ventzek et al. | |
| 6,213,175 | B1 | | 4/2001 | Rome et al. | |
| 6,523,580 | B1 | * | 2/2003 | Awad | 141/65 |

* cited by examiner

*Primary Examiner*—J Casimer Jacyna
(74) *Attorney, Agent, or Firm*—John J. Connors; Connors & Assoc., Inc.

(57) ABSTRACT

A coolant transfer machine for an automotive engine includes first and second fluid transfer systems. The first system, operated when the engine is not running, sequentially first removes at least a substantial portion of used coolant from the engine. The first system then collects in a used fluid container the used coolant as the used coolant is being removed and then replaces the removed used coolant with new coolant from a new fluid container. The second system, operated when the engine is running, simultaneously displaces at least a substantial portion of used coolant in the engine with new coolant from the new fluid container and collects the displaced used coolant in the used fluid container. A manually operable switch has a first position that enables operation of the first fluid transfer system and a second position that enables operation of the second fluid transfer system.

26 Claims, 11 Drawing Sheets

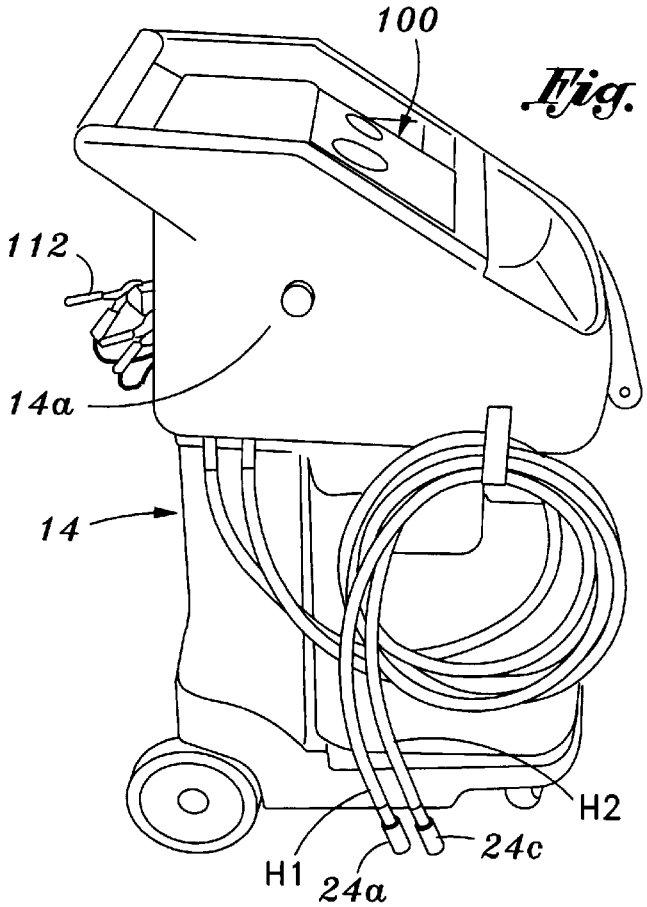
Fig. 8
Fig. 9
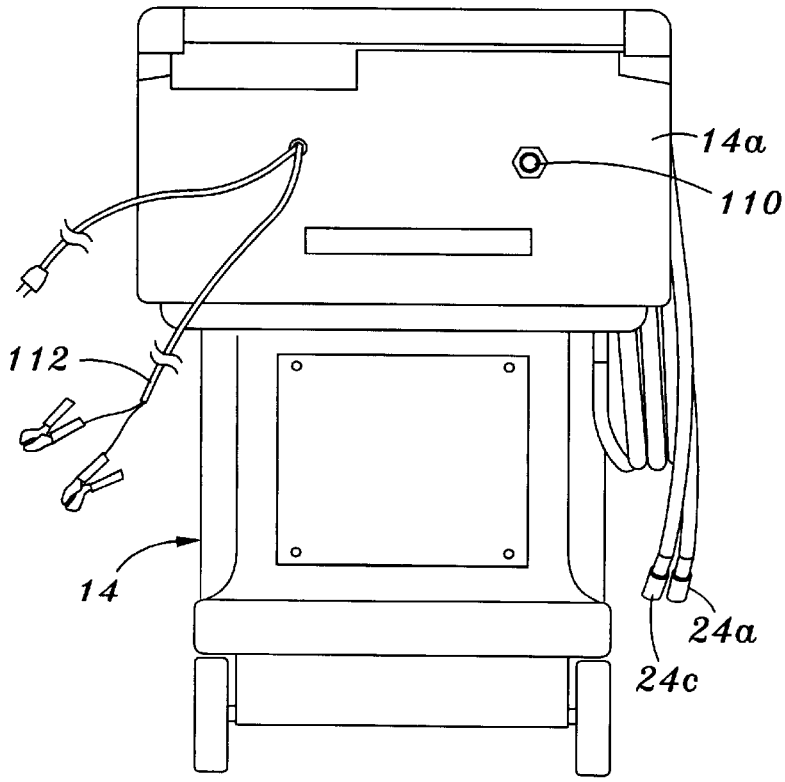

COOLANT TRANSFER MACHINE FOR AUTOMOTIVE VEHICLE & METHOD

RELATED PATENT APPLICATION & INCORPORATION BY REFERENCE

This application is a utility application based on U.S. provisional patent application Ser. No. 60/289,483, entitled "Coolant transfer Machine For Automotive Vehicle & Method," filed May 8, 2001. This related application is incorporated herein by reference and made a part of this application. Moreover, Applicants incorporate herein by reference any and all U.S. patents, U.S. patent applications, and other documents cited or referred to in this utility application or cited or referred to in the related provisional application.

BACKGROUND OF THE INVENTION

Servicing of automotive vehicles typically requires periodic replacement of the coolant in the cooling system for the vehicle's engine. Fluid transfer machines such as, for example, illustrated in U.S. Pat. Nos. 4,782,689; 4,888,980; 5,573,045; 5,615,716; 6,135,136; 6,152,193; 6,161,566; and 6,213,175B1, are sometimes used to transfer the used coolant to a storage vessel while replacing this used coolant with new coolant. Many coolant transfer machines employ a system relying on the vehicle's engine to provide the power to effect the coolant transfer. In some instances this limits the speed at which the transfer can be accomplished. Other coolant transfer machines shut the engine off and employ a different system relying on external means for providing the power to transfer coolant.

SUMMARY OF THE INVENTION

This invention has several features. Without limiting the scope of this invention as expressed by the claims that follow, its more prominent features will now be discussed briefly. After considering this discussion, and particularly after reading the section entitled, "DETAILED DESCRIPTION," one will understand how the features of this invention provide its benefits, which include, but are not limited to, rapid transfer of coolant, a hybrid system that allows the user to select between two different systems the one best suited for the vehicle being serviced, avoiding creating "hot spots" in the engine's cooling system, and economies in that the hybrid system is contained within a single housing and shares common components.

In accordance with this invention, coolant is transferred to and from an automotive engine having a radiator in communication with the engine using a machine that carries a new fluid container that holds new coolant and a used fluid container that holds used coolant from the engine. The first feature of the coolant transfer machine of this invention is that it includes two fluid transfer systems: A first fluid transfer system that sequentially first removes at least a substantial portion of used coolant from the engine and collects in the used fluid container the used coolant as the used coolant is being removed and then replaces the removed used coolant with new coolant from the new fluid container. And a second fluid transfer system that simultaneously displaces at least a substantial portion of used coolant in the engine with new coolant from the new fluid container and collects the displaced used coolant in the used fluid container. The engine is not operational while the first fluid transfer system is transferring coolant and the engine is operational while the second fluid transfer system is transferring coolant. A manually operable switch is used to select the fluid transfer system to be used based on the type of service to be provided: Namely, a quick service where the first fluid transfer system is typically used, or more complete service that requires more time where the second fluid transfer system is typically used, or a service that depends on the type of individual engine being serviced, where either the first or second fluid transfer system may be used.

Optionally, the second fluid transfer system includes a closed loop circuit that recycles fluid between the radiator and engine rather than transferring used fluid from the engine to the used fluid container and new fluid from the new fluid container to the radiator. The containers each include a sensor. The sensor in the new fluid container initiates the closed loop circuit when the sensor detects that the new fluid container is empty or near empty. The sensor in the used fluid container initiates the closed loop circuit when the sensor detects that the used fluid container is full or near full.

The second feature of this invention is that the first fluid transfer system includes a first adapter that is first manually inserted into an opening in the radiator upon removal of a radiator cap covering this opening. This first adapter may be in the form of a plug that is inserted into the opening. The adapter is then manually connected to the used fluid container to establish communication between the radiator and the used fluid container to transfer the used coolant from the engine to the used fluid container via the radiator. After withdrawing used coolant from the radiator, the first adapter is manually connected to the new fluid container to establish communication between the radiator and the new fluid container to transfer new coolant to the engine via the radiator. In an alternate embodiment of the first fluid transfer system, the engine is placed in communication with the containers via a connector attached to a radiator over flow member. A first pump is manually placed in communication with the used fluid container and the radiator to pump the used coolant from the engine through the radiator and into the used fluid container to create a reduced pressure in the engine. Upon establishing communication between the new fluid container and the radiator, the reduced pressure in the engine sucks new fluid into the radiator to replace the removed used coolant with new coolant.

The third feature of this invention is that the second fluid transfer system includes a pair of adapters. The coolant in the engine flows from the engine into the radiator through a manual detachable member such as, for example, a rubber tube. Upon manually detaching the detachable member, the pair of adapters is attached to provide access of coolant to the radiator and the engine. One adapter establishes communication with the new fluid container to transfer new coolant to the engine via the radiator. The other adapter establishes communication with the used fluid container to collect used coolant being displaced by the new coolant from the new fluid container.

The fourth feature of this invention is the use of hoses to establish communication between the containers and the engine through the adapters or the connector attached to the radiator over flow member. A drain hose is placed in communication with the used fluid container to transfer the used coolant from the engine to the used fluid container. And a supply hose is placed in communication with the new fluid container to transfer new coolant to the engine after transfer of the substantial portion of the used coolant from the engine. The hoses are manually connected and disconnected to individual adapters or the connector attached to a radiator over flow member depending on which fluid transfer system is being used. These hoses, adapters, and connector attached to the radiator over flow member employ conventional quick connect-disconnect connectors. These conventional quick connect-disconnect connectors each have one coupling component attached to a hose and another coupling component attached to an adapter or the connector for the radiator over flow member. These coupling components interact very quickly and have interlocking elements that, when the coupling components are connected or disconnected, maintain substantially the reduced pressure in the engine, preventing air at atmospheric pressure from entering the radiator, engine or either fluid transfer system.

The fifth feature of this invention is that the machine has a housing with a control panel and a base that supports the new fluid container and the used fluid container. The containers are free-standing and capable of being individually removed from the base and replaced. The first and second fluid transfer systems are within this housing and the drain hose, supply hose, the first pump, and a second pump along the supply hose are common components of both systems. The first pump is operated only when the first fluid transfer system is operational and second pump is operated only when the second fluid transfer system is operational.

The sixth feature of this invention is that the first and second fluid transfer systems have a common waste removal system operable when said first and second fluid transfer systems are disconnected from the engine. This common waste removal system transfers to a waste storage container used coolant in the used fluid container.

This invention also includes a method of transferring coolant to and from an automotive engine having an engine cooling system including a radiator. This method includes the steps of:

(a) providing a new fluid container holding new coolant and a used fluid container for holding used coolant from the engine, (b) providing a first fluid transfer system that sequentially first removes at least a substantial portion of used coolant from the engine and collects in a used fluid container the used coolant as said used coolant is being removed and then replaces said removed used coolant with new coolant from a new fluid container, said engine being non-operational when coolant is being transferred, (c) providing a second fluid transfer system that simultaneously displaces at least a substantial portion of used coolant in the engine with new coolant from the new fluid container and collects the displaced used coolant in the used fluid container, said engine being operational when coolant is being transferred, and (d) selecting one of said fluid transfer systems to transfer coolant based on the type of service to be provided.

DESCRIPTION OF THE DRAWING

The preferred embodiments of this invention, illustrating all its features, will now be discussed in detail. These embodiments depict the novel and non-obvious coolant transfer machine, systems and method of this invention as shown in the accompanying drawing, which is for illustrative purposes only. This drawing includes the following figures (FIGS.), with like numerals indicating like parts:

FIG. 8 is a perspective view of the side of the housing shown in FIG. 6.

FIG. 9 is a rear view of the housing shown in FIG. 6.

DETAILED DESCRIPTION OF THE PREFERRED EMBODIMENTS

Figure 1:
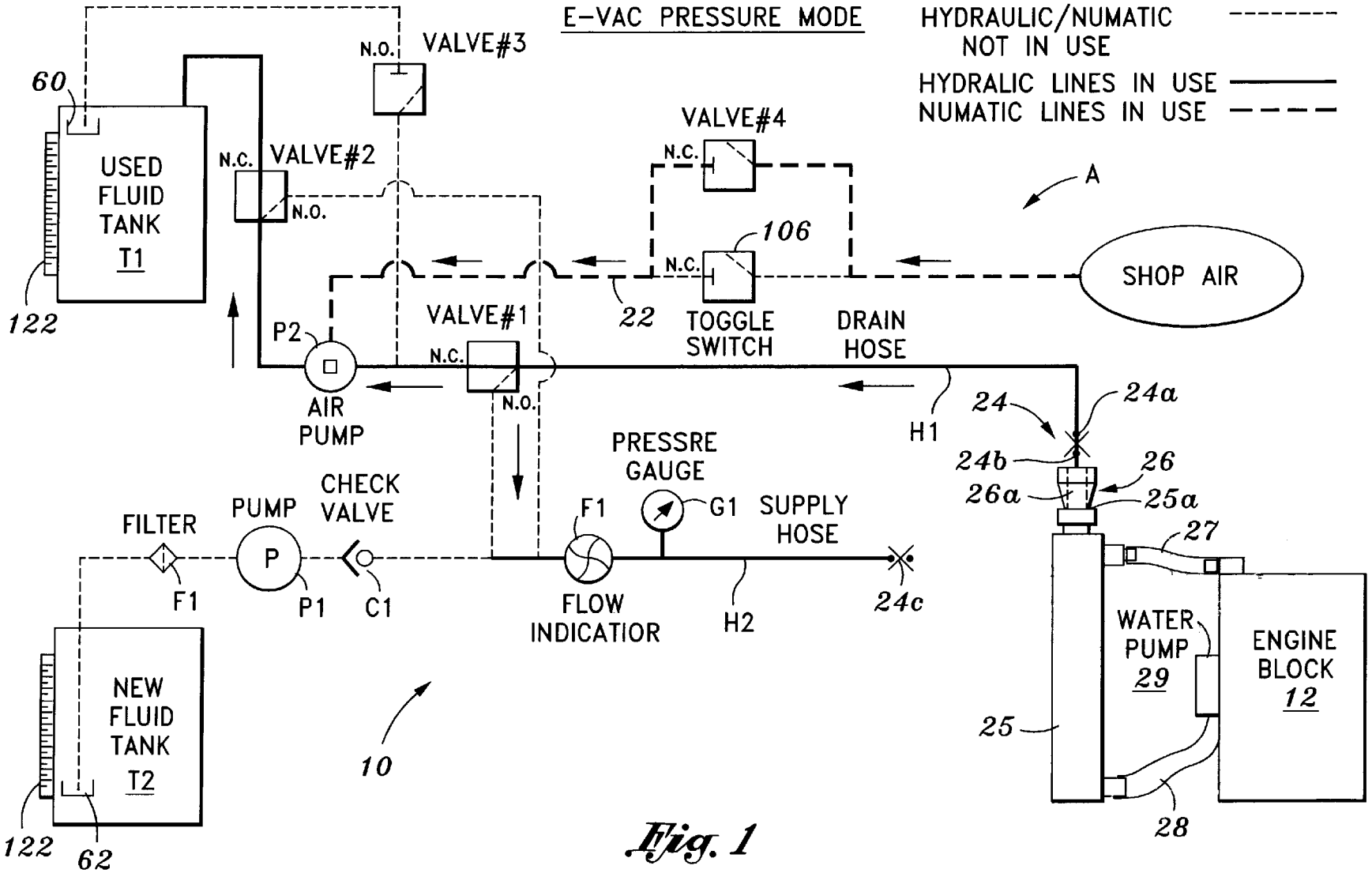
FIG. 1 is a schematic diagram of the hybrid coolant transfer machine of this invention showing the vehicle's engine off and the first fluid transfer system in the evacuation mode wherein used coolant is transferred from the engine's cooling system to a used fluid container (Used Fluid Tank T1).
Figure 2:
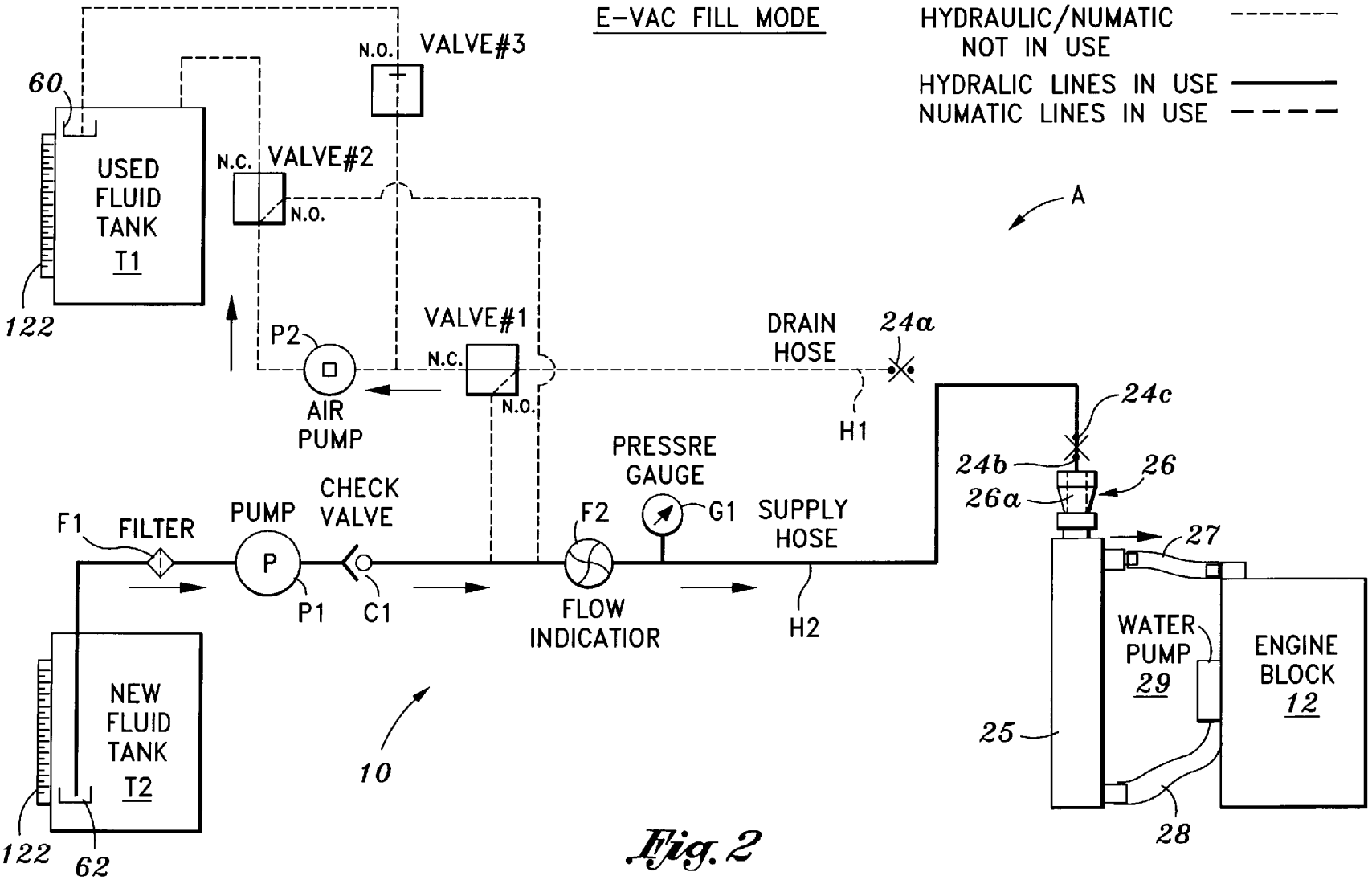
FIG. 2 is a schematic diagram of the hybrid coolant transfer machine shown in FIG. 1 and the first fluid transfer system in the fill mode wherein new coolant is transferred to the engine's cooling system from a new fluid container (New Fluid Tank T2).
Figure 2A:
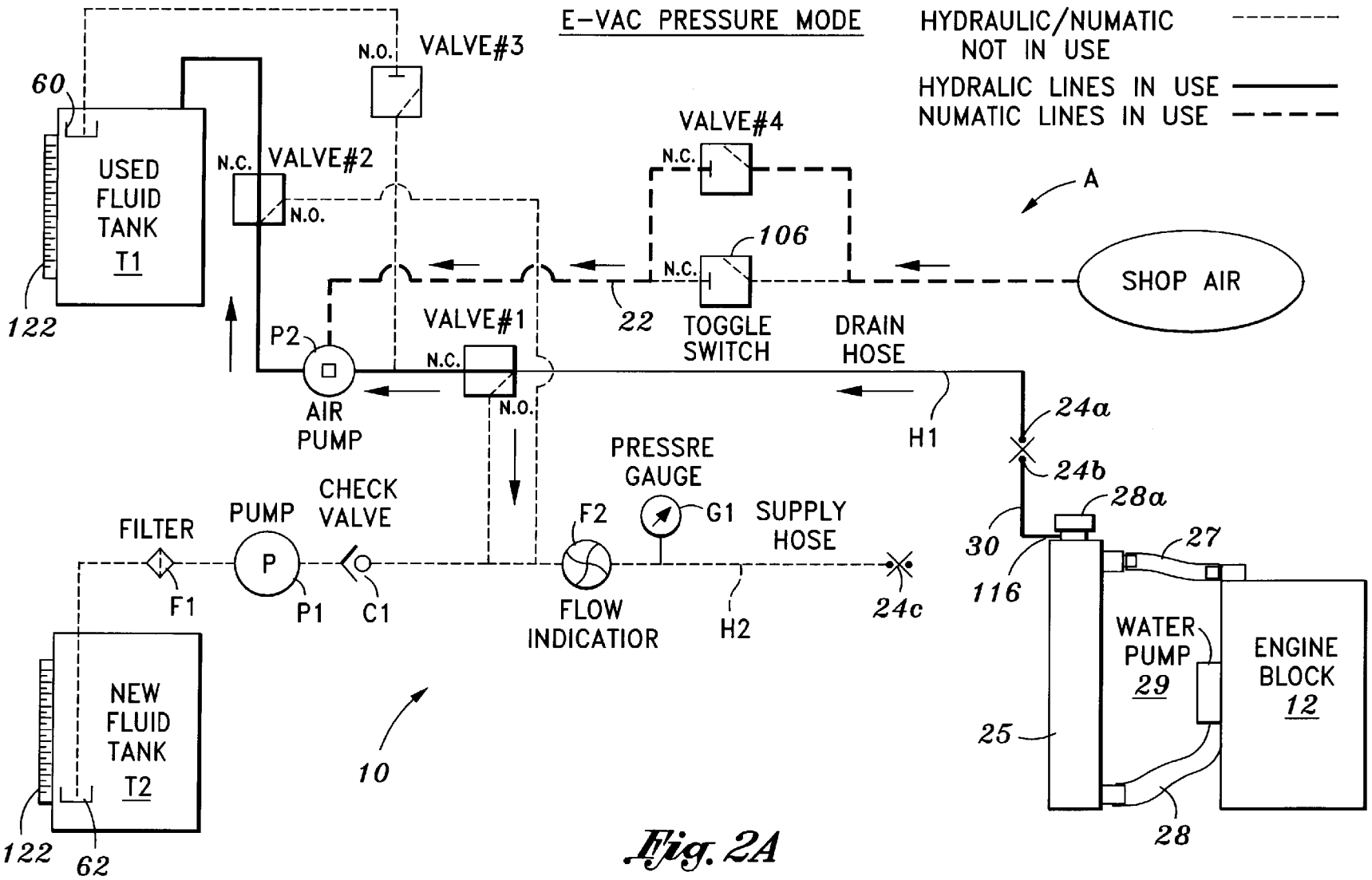
FIG. 2A is a schematic diagram of an alternate embodiment of the hybrid coolant transfer machine of this invention showing the vehicle's engine off and the first fluid system in the evacuation mode wherein used coolant is transferred from the engine's cooling system to a used fluid container via a radiator over flow tube.
Figure 3:
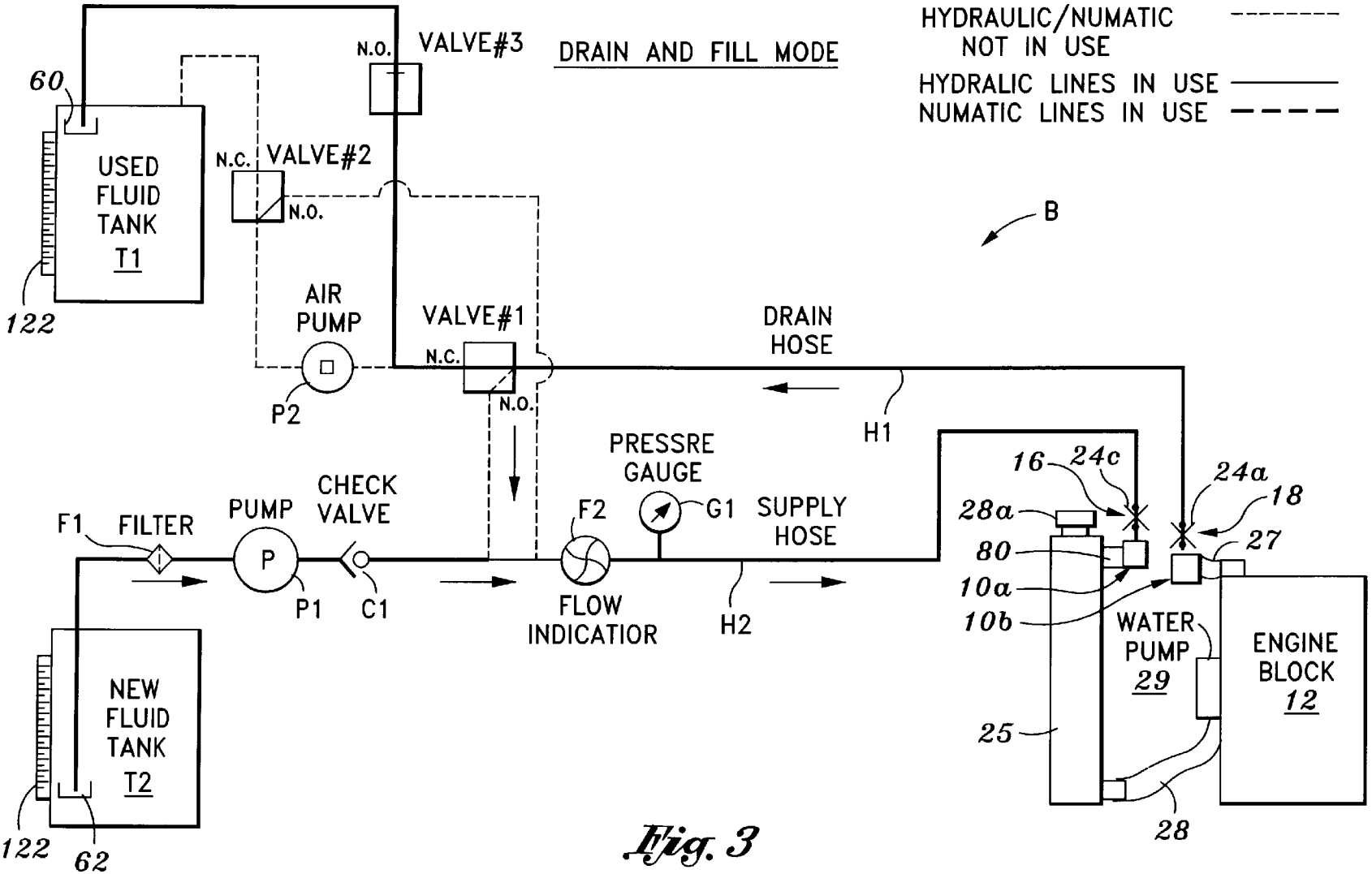
FIG. 3 is a schematic diagram of the hybrid coolant transfer machine of this invention showing the vehicle's engine on and the second fluid transfer system operational wherein used coolant is displaced from the engine's cooling system and transferred a used fluid container as new coolant is pumped into the engine's cooling system from the new fluid container.
Figure 4:
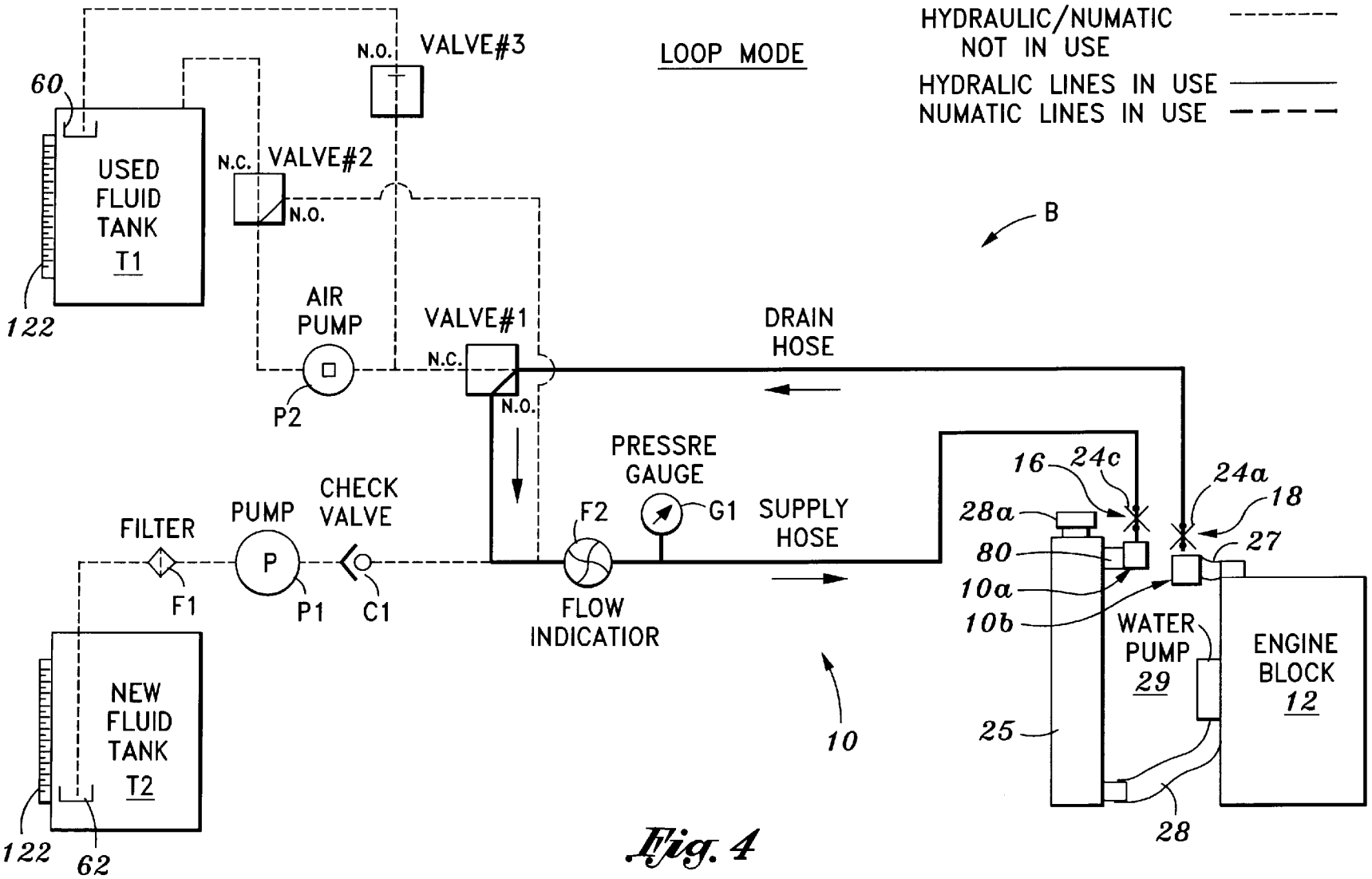
FIG. 4 is a schematic diagram of the hybrid coolant transfer machine shown in FIG. 3 with the vehicle's engine on and the second fluid system operational and in a loop mode.

As illustrated in FIGS. 1 through 5, the hybrid coolant transfer machine 10 of this invention employs two fluid transfer systems, the Evac system A (FIGS. 1, 2 and 2A) adapted to be operated when the vehicle's engine 12 is not operating and the Flush system B adapted to be operated when the vehicle's engine is operating (FIGS. 3 and 4). The components of both fluid transfer systems A and B are mounted to, or contained within, a housing 14 shown in FIGS. 6, 8 and 9. The housing 14 includes a cover 14*a* with hinges 14*b*, rectangular base 14*c*, and, centrally positioned on the base, a pedestal (not shown) that extends upward in a vertical orientation to provide a partition. As best shown in FIG. 2, fixedly attached to the top of the pedestal 14 is a flat, rectangular, planar platform P oriented horizontally. This platform P is used to support components of the fluid transfer machine 10. The structural features of the housing 14 are discussed in detail in U.S. provisional patent application Serial No. 60/266,399, filed Feb. 2, 2001, and U.S. utility patent application Ser. No. 10/059,868, filed Jan. 29, 2002, based on the provisional patent application Serial No. 60/266,399, both assigned to MOC Products Company, Inc., the assignee of this utility patent application.

Figure 6:
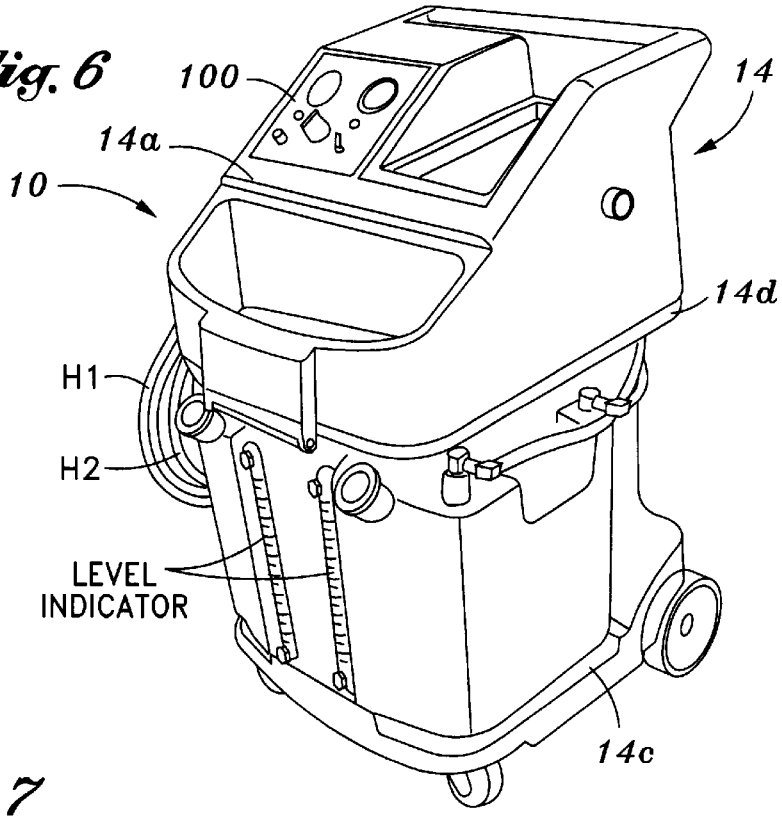
FIG. 6 is a perspective view of the hybrid coolant transfer machine of this invention showing the machine's housing which includes the first and second fluid transfer systems depicted in FIGS. 1 and 3.
Figure 7:
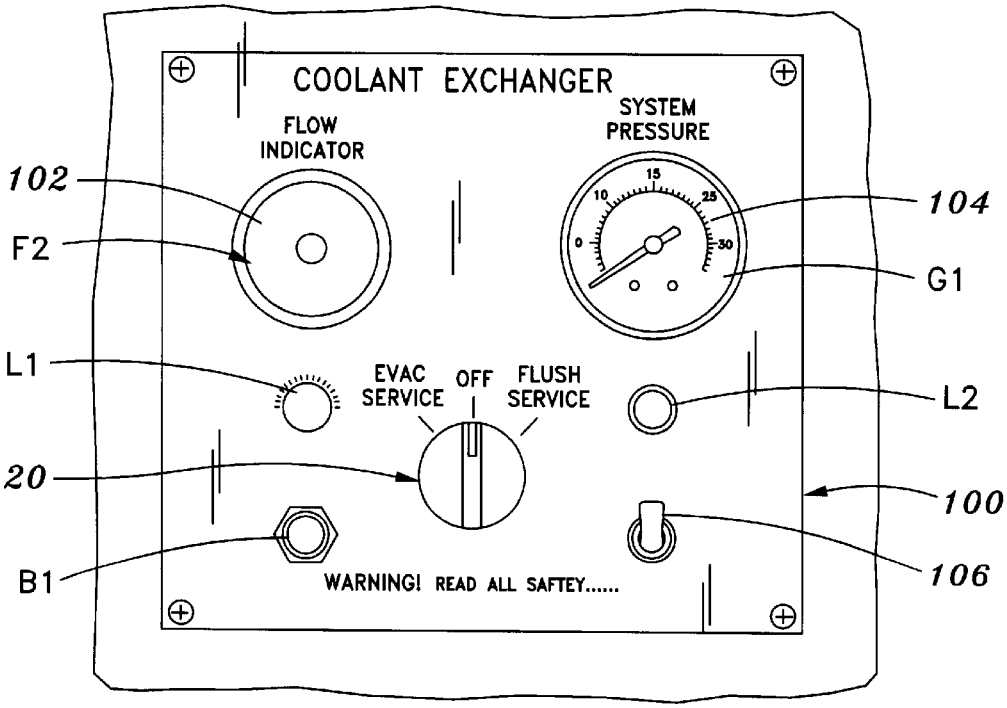
FIG. 7 is an enlarged, fragmentary view of the control panel displayed on the outside of the cover of the housing shown in FIG. 6.
Figure 10:
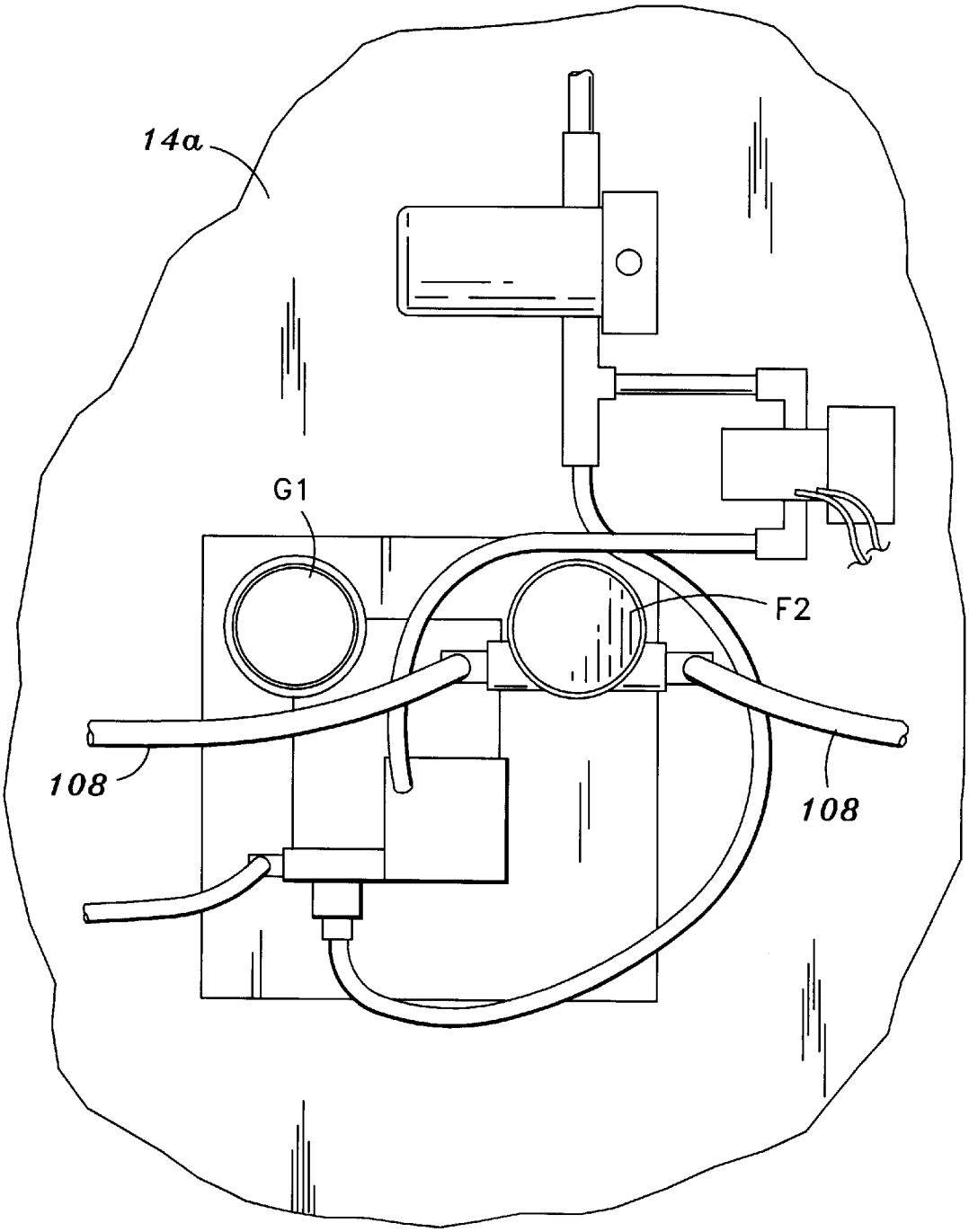
FIG. 10 is a plan view of an internal wall of the housing cover showing the backside of the control panel.
Figure 11:
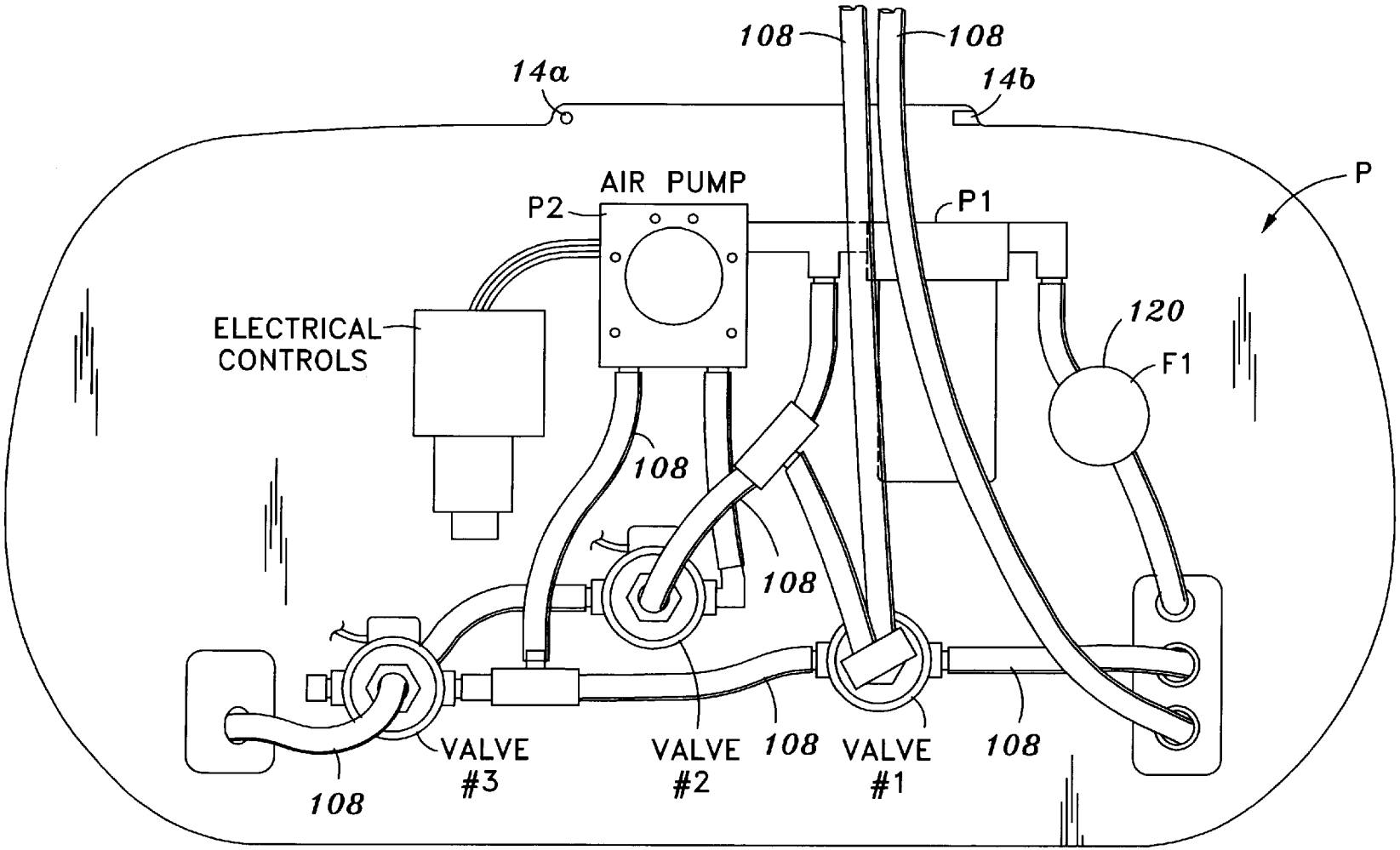
FIG. 11 is a plan view of the exterior top of the housing platform showing various components of the hybrid coolant transfer machine of this invention.

In accordance with this invention, both the systems A and B include the following common components: Used Fluid Tank T1, New Fluid Tank T2, solenoid actuated Valve #1, solenoid actuated Valve #2, a 30 Micron Filter F1, 12 Volt Pump P1, Check Valve C1, Flow Indicator F2, Pressure Gage G1, Drain Hose H1, Supply Hose H2, and a control panel 100 (FIG. 7) displayed on the upper, front exterior of the cover 14*a* of the housing 14. As best shown in FIG. 7, the control panel 100 includes a flow indicator display 102, a system pressure gauge display 104 (the system pressure gauge G1 is downstream of the flow indicator F1), a main switch 20 with its control knob 20*a* on the panel 100, a service complete indicator light L1, a used fluid tank full light L2, top off pump control button B1, and a mechanical toggle switch 106 for actuating an Air Pump P2. (An electrical pump may be used in place of the Air Pump P2 and an electrical switch used in place of the toggle switch 106 to operate a relay for actuating the electrical pump.) The hoses 108 shown in FIGS. 6, 10 and 11 are internal plumbing hoses connecting the components of the systems A and B together as depicted schematically in FIGS. 1 through 5. The system A also includes a solenoid actuated Air Valve #4, and a Radiator Hose Adapter or plug 26. The system B also includes a solenoid actuated Valve #3, and a pair of adapters 16 and 18 that are disclosed in detail in U.S. utility patent application Ser. No. 09/850,831, filed in the names of Michael J. Camacho and Carl Brod on May 8, 2001, and entitled "Adapter For A Coolant Transfer Machine, Methods Of Transferring Coolant & Kit," and assigned to MOC Products Company, Inc., the assignee of this utility patent application.

Figure 12:
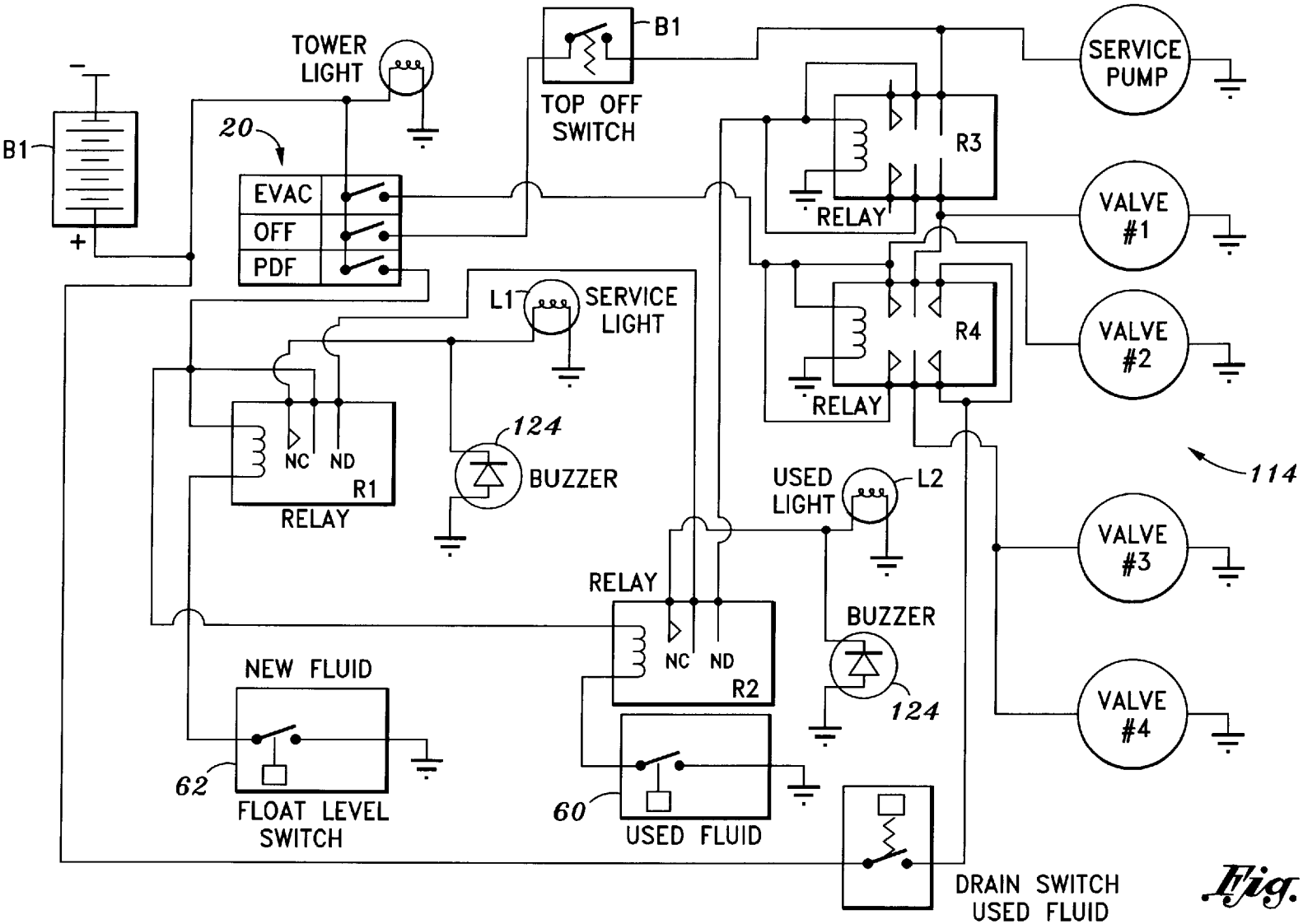
FIG. 12 is a schematic wiring diagram of the control circuit for the hybrid coolant transfer machine of this invention.

As depicted in FIG. 1, when using the system A, the engine 12 is shut off so that it is non-operational and the knob 20*a* of the main switch 20 on the control panel 100 (FIG. 7) is turned manually to the position "Evac Service" to energize the solenoid controlled Air Valve #4 to place the Air Pump P2 through the Valve #4 in communication with a source of air under pressure (Shop Air) to provide air to actuate the Air Pump. As shown in FIG. 9, there is a port 110 that enables an air line 22 from the source of air (Shop Air) to be connected to the machine 10. There are also jumper cables 112 attached to the rear exterior wall of housing 14 to allow the machine's control circuit 114 (FIG. 12) to be connected to the battery B1 of the vehicle being serviced.

The plug 26 and the Drain Hose H1 are connected by a conventional two component quick connect-disconnect coupling 24. A suitable two component quick connect-disconnect coupling 24 may be obtained form, Rectus GMBH, a German company, dba Oboc with office in Sparta, N.J. The terminal end of the Drain Hose H1 has one component 24*a* and the plug 26 has extending from it the other component 24*b*. The Supply Hose H2 has a component 24*c* connected to its terminal end for connecting the Supply Hose H2 as illustrated in FIG. 2. The plug 26 is inserted into a top opening 25*a* in the radiator 25 that is normally closed by a radiator cap 28*a* (FIG. 2A). When using system A, the radiator cap 28*a* is removed to uncover this opening 25*a* prior to insertion of the plug 26. In an alternate embodiment shown in FIG. 2A, the radiator cap 28*a* is not removed and the Drain Hose H1 is connected to a Radiator Over Flow Tube 116 via a detachable member 30 having at its terminal end the component 24*b* for connection to the component 24*a*.

With the knob 20*a* of the main switch 20 on the control panel 100 (FIG. 7) turned to the "Evac Service" position, Relays R1, R2, R3, and R4 in the control circuit 114 are energized so that the Valves #1, #2, #3 and #4 are in position shown in FIG. 1 to enable used coolant to flow from the engine cooling system, the radiator 24, hoses 27 and 28, the engine's water pump 29, and the engine's internal cooling passageways (not shown) via the plug 26, the Drain Hose H1, and Valves #1 and #2 into the Used Fluid Tank T1. The Valves #1, #2, and #3, are located within the housing 14 as shown in FIG. 11 on the flat, rectangular, planar, horizontal platform P of the housing. The cover 14*a* is attached to the platform P by hinges 14*b*. This platform P is also used to support the Air Pump P2, 12 Volt Pump P1, a Filter Housing 120 for the 30 Micron Filter F1, and at least some of the components of the control circuit, for example, the relays R1, R2, R3, and R4. As shown in FIG. 11, these components may be accessed by raising the housing cover 14*a*.

The open Valve #4 allows air under pressure to flow through the air line 22 to the Air Pump P2 which pumps the used coolant from the engine cooling system into the Used Fluid Tank T1. This reduces the pressure within the engine's cooling system. Depending on the type of vehicle being serviced from about 20 to about 80, or even greater, volume percent of the coolant in the engine cooling system is transferred into the Used Fluid Tank T1. The technician may access the engine's cooling system prior to adding new coolant, for example, to replace a thermostat. If this was done, the engine's cooling system would be at atmospheric pressure. In such a case, after accessing the engine's cooling system to replace the thermostat, the technician would again reconnect (if disconnected) the Drain Hose H1 as shown in FIG. 1 and turn the main switch 20 to the Evac Service position to again remove some more used coolant and reduce the pressure in the engine's cooling system. The Drain Hose H1 is now disconnected and the Supply Hose H2 connected as shown in FIG. 2.

As illustrated in FIG. 2, upon completion of removal of used coolant from the engine cooling system, the knob 20*b* of the main switch 20 is turned to its OFF position and the Drain Hose H1 is disconnected from the plug 26 by detaching the coupling component 24*a* from the coupling component 24*b* and the coupling component 24*c* on the end of the Supply Hose H2 is attached to the coupling component 24*b*. The quick connect-disconnect couplings components 24*a* and 24*b* and 24*c* all close immediately upon being disconnected. Consequently, the use of a two component quick connect-disconnect coupling 24 avoids introducing air into the cooling system upon disconnecting the Drain Hose H1 and connecting the Supply Hose H2, and the reduced pressure is maintained within the engine's cooling system.

The new (unused) coolant is fed from the New Fluid Tank T2 via the Supply Hose H2 through the 30 Micron Filter F1, the 12 Volt Pump P1, the Check Valve C1, the Flow Indicator F2, a passageway 26*a* (shown in dotted lines) in the plug 26 into the radiator 25 though the radiator opening 25*a*. Because of the reduced pressure within the engine's cooling system, the new coolant is simply sucked into the engine's cooling system. The new coolant flows through the 12 Volt Pump P1 under the influence of the reduced pressure in the engine's cooling system. This avoids pulling air into the engine's cooling system and "hot spots" are avoided. The 12 Volt Pump P1 is only energized by the technician depressing the top off pump control button B1 shown on the control panel 100 (FIG. 7). Both the Used Fluid Tank T1 and New Fluid Tank T2 each have Level Indicators 122 that provide a visual indication of the liquid level in a tank. The technician by observing the liquid levels in each of these tanks can determine how much coolant has been removed from the engine's cooling system, and how much new coolant has been added. If all the used coolant has not been replaced with new coolant by simply sucking new coolant into the engine's cooling system under the influence of the reduced pressure within the engine's cooling system, the top off pump control button B1 is actuated to energized the 12 Volt Pump P1 to add more new coolant to the cooling system until all the withdrawn used coolant has been replaced. When the engine cooling system is filled with new coolant, the Supply Hose H2 is disconnected by detaching the coupling components 24*c* and 24*b* and removing the plug 26 and replacing the radiator cap 28*a*.

As depicted in FIG. 3, when using the system B, the engine 12 is maintained turned on so that it is operational and the knob 20*a* of the main switch 20 on the control panel 100 (FIG. 7) is turned manually to the "Flush Service" position to actuate the 12 Volt Pump. System B is based on a displacement principal wherein the new coolant pushes the used coolant from the engine's cooling system. The radiator cap 28*a* remains in place. Prior to activating the system B, one end of the hose 27 is disconnected from the radiator 25 and adapters 10*a* and 10*b* are connected as shown in FIG. 3 to place the engine's cooling system in communication with the Used Fluid Tank T1 and New Fluid Tank T2 for transfer of used coolant from the engine cooling system to the Used Fluid Tank T1 and new coolant from the New Fluid Tank T2 to the engine cooling system. (MIKE, IS THIS TRUE? Although hose 27 is shown as disconnected, the hose 28 could be disconnected instead of hose 27, and the Supply Hose H2 could be connected to the engine 12 and the Drain Hose H1 connected to the radiator 25.) New coolant displaces used coolant, flowing from the New Fluid Tank T2 into the radiator 25 through the Supply Hose H2 via the 30 Micron Filter F1, the 12 Volt Pump P1, the Check Valve C1, the Flow Indicator F2, the adapter 10*a,* and a replacement conduit 80 placing the radiator 25 in communication with the adapter 10*a*. Used coolant flows from the engine 12 into the Used Fluid Tank T1 through the Drain Hose H1 via the open Valves #1 and #2.

As illustrated in FIG. 4, system B may be operated in a loop mode whereby the used coolant circulates via a connector tube 50 between the Drain Hose H1 and Supply Hose H2. In this loop mode, coolant is continually recycled between the engine 12 and the radiator 25 via the hose 27, the adapter 10*b,* the Drain Hose H1, the Valve #1, the connector tube 50, the Flow Indicator F2, the Supply Hose H2, the adapter 10*a,* and the replacement conduit 80. There is a sensor 60 (FIGS. 1, 3, and 12) located near the top of the Used Fluid Tank T1 and a sensor 62 (FIGS. 1, 3, and 12) near the bottom of the New Fluid Tank T2, which, respectively, detect when the Used Fluid Tank T1 is almost full and when the New Fluid Tank T2 is almost empty. The sensors 60 and 62 are float switches. When either of these conditions is detected by either one of these sensors 60 or 62, the system B is switch to the loop mode. The system B is also switch to the loop mode when the service is completed by displacing the maximum amount of used coolant in the engine's cooling system. When system B is in the loop mode, a buzzer 124 (FIGS. 10 and 12) is activated to provide an audio alarm and the service complete light L1 on the control panel 100 is illuminated.

Figure 5:
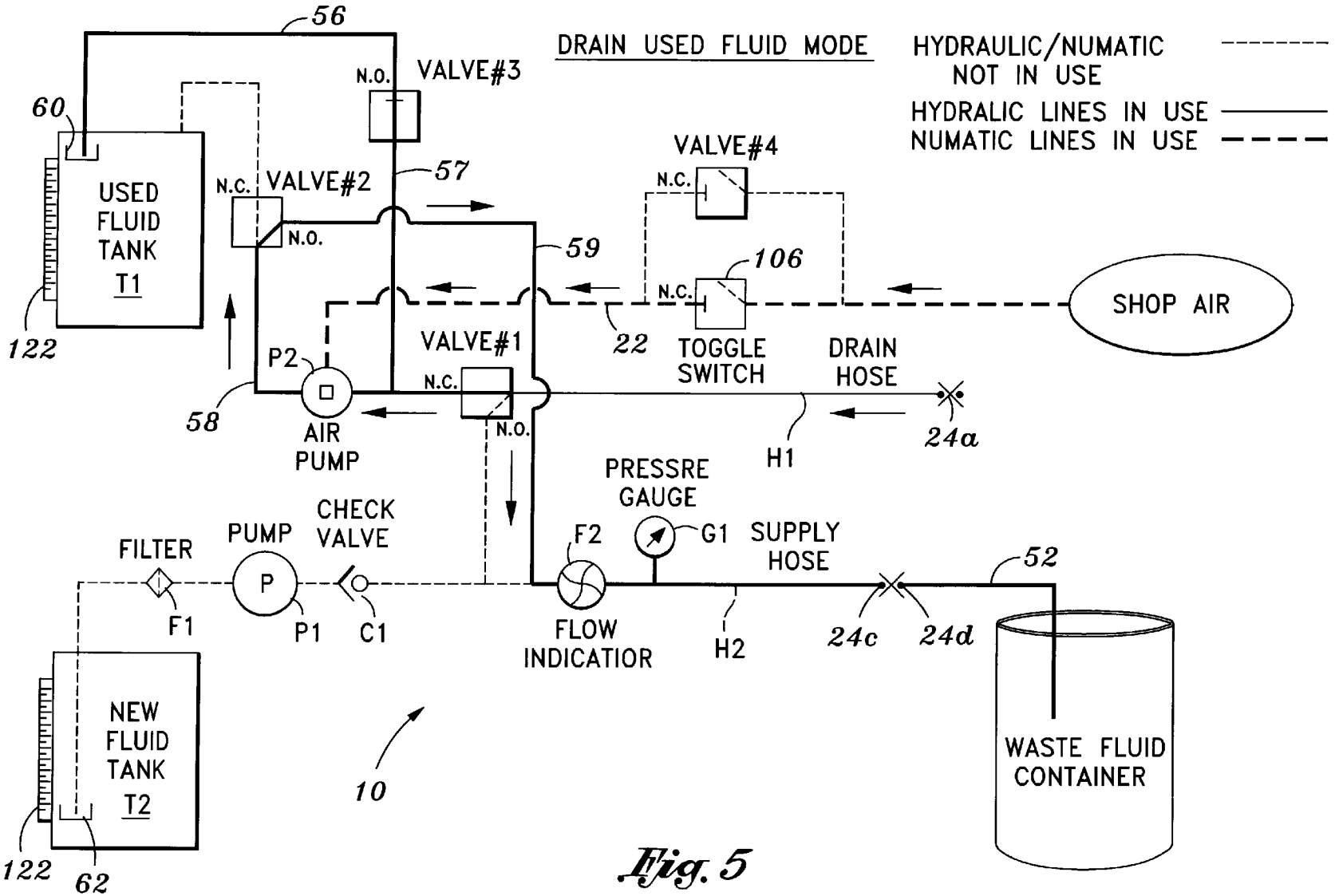
FIG. 5 is a schematic diagram of the hybrid coolant transfer machine shown in FIGS. 1 and 3 with the vehicle's engine disconnected from the machine and used coolant in the used fluid container being transferred to a waste storage container.

As depicted in FIG. 5, the coolant transfer machine 10 may be operated in a Drain Used Fluid Mode. In this mode, the Drain Hose H1 and Supply Hose H2 are disconnected from the engine 12 and the Supply Hose H2 is connected by the coupling component 24*c* to a coupling component 24*d* on one end of a conduit 52 having another end connected to a Waste Fluid Container. Upon actuating the Toggle Switch, the pressurized air is supplied to the Air Pump, activating this pump. This causes used coolant in the Used Fluid Tank T1 to flow via the conduit 56 through the Valve #3, conduit 57, the Air Pump, conduit 58, the Valve #2, conduit 59 to the inlet of the Flow Indicator and out the outlet of the Flow Indicator through the Supply Hose H2 and conduit 52 into the Waste Fluid Container.

The advantage of employing both systems A and B in the hybrid coolant transfer machine 10 is that the technician using the machine 10 will then have the ability to select the system (A or B) best suited to service a particular vehicle. With the system A, the technician does not have to disconnect hose 27 (or the hose 28), but simply replaces the radiator cap 28*a*. This saves time. But with some vehicles, it may be more advantageous to use system B, because a greater displacement of used coolant is achieved than would be possible using system A.

What is claimed is:

1. A machine for transferring coolant to and from an automotive engine having a radiator in communication with the engine, said machine including a first fluid transfer system that sequentially first removes at least a substantial portion of used coolant from the engine and collects in a used fluid container the used coolant as said used coolant is being removed and then replaces said removed used coolant with new coolant from a new fluid container, a second fluid transfer system that simultaneously displaces at least a substantial portion of used coolant in the engine with new coolant from the new fluid container and collects the displaced used coolant in the used fluid container, and a manually operable switch having a first position that enables operation of the first fluid transfer system and a second position that enables operation of the second fluid transfer system.

2. The machine according to claim 1 where the engine is not operational while the first fluid transfer system is transferring fluid and the engine is operational while the second fluid transfer system is transferring fluid.

3. The machine according to claim 1 where the first fluid transfer system includes a drain hose placed in communication with the used fluid container to transfer said substantial portion of the used coolant from the engine to the used fluid container, and a supply hose placed in communication with the new fluid container to transfer new coolant to the engine after transfer of said substantial portion of the used coolant from the engine.

4. The machine according to claim 1 where the radiator includes an opening therein closed by a radiator cap that is removed prior to placing the first fluid transfer system in communication with the engine through the opening.

5. The machine according to claim 4 where the first fluid transfer system includes a first adapter that is inserted into the opening in the radiator upon removal of the radiator cap, and the second fluid transfer system includes a pair of adapters, one adapter placing the new fluid container in communication with the radiator to transfer new coolant to the engine via the radiator and the other adapter placing the used fluid container in communication with the engine to collect used coolant being displaced by the new coolant from the first container.

6. The machine according to claim 5 where the adapters each include a quick connect-disconnect connector.

7. The machine according to claim 1 where the radiator includes radiator over flow member through which the first fluid transfer system is placed in communication with the engine.

8. The machine according to claim 7 where the first fluid transfer system has a drain hose adapted to be connected to the radiator over flow member by a quick connect-disconnect connector and a supply hose adapted to be connected to the radiator over flow member by a quick connect-disconnect connector.

9. A machine for transferring coolant to and from an automotive engine having a radiator in communication with the engine via a detachable member and an opening closed by a radiator cap, said machine including a housing having a control panel and a base that supports a new fluid container that holds new coolant and a used fluid container that holds used coolant from the engine, said containers capable of being removed from the base and replaced, a first fluid transfer system that removes at least a substantial portion of used coolant from the engine and replaces said removed used coolant with new coolant from the new fluid container and collects the removed used coolant in the used fluid container, said first fluid transfer system including a first adapter that is first manually inserted into the opening in the radiator upon removal of the radiator cap and then manually connected to the used fluid container to establish communication between the radiator and the used fluid container to transfer said substantial portion of the used coolant from the engine to the used fluid container via the radiator, and thereafter said first adapter is manually connected to the new fluid container to establish communication between the radiator and the new fluid container to transfer new coolant to the engine via the radiator, and a second fluid transfer system that simultaneously displaces at least a substantial portion of used coolant in the engine with new coolant from the new fluid container and collects the displaced used coolant in the used fluid container, said second fluid transfer system including a pair of adapters that, upon manually detaching the detachable member, are attached to provide access to the radiator and the engine, one adapter establishing communication with the new fluid container to transfer new coolant to the engine via the radiator and the other adapter establishing communication with the used fluid container to collect used coolant being displaced by the new coolant from the new fluid container, and a manually operable switch in the control panel having a first position that enables operation of the first fluid transfer system and a second position that enables operation of the second fluid transfer system.

10. The machine according to claim 9 where the engine is not operational while the first fluid transfer system is transferring fluid and engine is operational while the second fluid transfer system is transferring fluid.

11. A machine for transferring coolant to and from an automotive engine having an engine cooling system with a radiator over flow member, said engine cooling system being in communication with the engine via a detachable member, said machine including a housing having a control panel and a base that supports a new fluid container that holds new coolant and a used fluid container holds used coolant from the engine, said containers capable of being removed from the base and replaced, a first fluid transfer system for removing at least a substantial portion of used coolant from the engine and replacing said removed used coolant with new coolant from the new fluid container and collecting in the used fluid container the removed used coolant, said first fluid transfer system including a connector that is connected to the radiator over flow member, said connector first being placed in communication with the used fluid container to transfer said substantial portion of the used coolant from the engine to the used fluid container, and thereafter said connector being placed in communication with the new fluid container to transfer new coolant to the engine, and a second fluid transfer system for displacing at least a substantial portion of used coolant in the engine with new coolant from the new fluid container and collecting the displaced used coolant in the used fluid container, said second fluid transfer system including a pair of adapters that are attached upon manually detaching the detachable member to provide access to the radiator and the engine, one adapter being place in communication with the new fluid container to transfer new coolant to the engine via the radiator and the other adapter establishing communication between the engine and the used fluid container to collect used coolant being displaced by the new coolant from the new fluid container, and a manually operable switch in the control panel having a first position that enables operation of the first fluid transfer system and a second position that enables operation of the second fluid transfer system.

12. The machine according to claim 11 where the engine is not operational while the first fluid transfer system is transferring fluid and engine is operational while the second fluid transfer system is transferring fluid.

13. A machine for transferring coolant to and from an automotive engine having a radiator in communication with the engine, said machine including a first fluid transfer system that only operates when the engine is not operational, said first fluid transfer system sequentially first removes at least a substantial portion of used coolant from the engine and collects in a used fluid container the used coolant as said used coolant is being removed and then replaces said removed used coolant with new coolant from a new fluid container, a second fluid transfer system that that only operates when the engine is operational, said second fluid transfer system simultaneously displaces at least a substantial portion of used coolant in the engine with new coolant from the new fluid container and collects the displaced used coolant in the used fluid container as said used coolant is being removed, and a manually operable switch having a first position that enables operation of the first fluid transfer system and a second position that enables operation of the second fluid transfer system;

said first and second fluid transfer systems having the following common components:

a housing for said fluid transfer systems having a control panel and a base that supports the new fluid container and the used fluid container holds, said containers capable of being removed from the base and replaced, a drain hose having one end in communication with the used fluid container and another end having a quick connect-disconnect connector, a supply hose having one end in communication with the new fluid container and another end having a quick connect-disconnect connector, and a pump along the supply hose that is enabled when the second fluid transfer system is to transfer new fluid from the new fluid container to the engine and that is disabled when the first fluid transfer system is to transfer new fluid from the new fluid container to the engine.

14. The machine according to claim 13 where the radiator includes an opening therein closed by a radiator cap that is removed prior to placing the first fluid transfer system in communication with the engine, and the first fluid transfer system includes an adapter that is inserted into the opening in the radiator upon removal of the radiator cap, said adapter having a connector that is manually coupled and de-coupled to the quick connect-disconnect connectors on the drain dose and supply hose.

15. The machine according to claim 13 where the radiator is in communication with the engine through a detachable member and the second fluid transfer system includes a pair of adapters that are attached upon manually detaching the detachable member to provide access to the radiator and the engine, one adapter placing the new fluid container in communication with the radiator to transfer new coolant to the engine via the radiator and the other adapter placing the used fluid container in communication with the engine to collect used coolant being displaced by the new coolant from the first container, said adapters each including a quick connect-disconnect connector.

16. The machine according to claim 13 where the first and second fluid transfer systems have a common waste removal system operable when said first and second fluid transfer systems are disconnected from the engine, said common waste removal system transferring to a waste storage container used coolant in the used fluid container.

17. A machine for transferring coolant to and from a radiator of an automotive engine that may be operational or may not be operational, said machine including a new fluid container of new coolant and a used fluid container adapted to hold used coolant from the engine, a first fluid transfer system that is operable while the engine is not operational, said first fluid transfer system having a first pump that is manually placed in communication with the used fluid container and the radiator to pump at least a substantial portion of used coolant from the engine through the radiator and into the used fluid container to create a reduced pressure in the engine, said communication between the used fluid container and radiator being discontinued upon removal of the substantial portion of used coolant, with the new fluid container and the radiator being manually placed in communication with the reduced pressure in the engine to suck new fluid into the radiator to replace said removed used coolant with new coolant, and a second fluid transfer system that is operable while the engine is operational, said second fluid transfer system having a drain hose member that is manually connected between the engine and the used container, and a supply hose member, including a second pump, that is manually connected between the radiator and the new fluid container, said hose members being connected prior to the engine being operational, so that while the engine is operational, new fluid from the new fluid container is pumped by said second pump to displace at least a substantial portion of used coolant in the engine, said displaced used coolant flowing through the drain hose and being collected in the used fluid container.

18. The machine according to claim 17 where the first pump is operated only when the first fluid transfer system is operational and second pump is operated only when the second fluid transfer system is operational.

19. The machine according to claim 17 including a manually operable switch having a first position that enables operation of the first fluid transfer system and a second position that enables operation of the second fluid transfer system.

20. The machine according to claim 17 where the second fluid transfer system includes a closed loop circuit that recycles fluid between the radiator and engine rather than transferring used fluid from the engine to the used fluid container and new fluid from the new fluid container to the radiator.

21. The machine according to claim 20 where the containers each include a sensor, the sensor in the new fluid container initiating the closed loop circuit when said sensor detects that the new fluid container is empty or near empty, and the sensor in the used fluid container initiating the closed loop circuit when said sensor detects that the used fluid container is full or near full.

22. The machine according to claim 17 where the first and second fluid transfer systems have a common waste removal system operable when said first and second fluid transfer systems are disconnected from the engine, said common waste removal system transferring to a waste storage container used coolant in the used fluid container.

23. A machine for transferring coolant to and from an automotive engine having a radiator in communication with the engine, said machine including a first fluid transfer system that only operates when the engine is not operational, said first fluid transfer system sequentially first removes at least a substantial portion of used coolant from the engine and collects in a used fluid container the used coolant as said used coolant is being removed and then replaces said removed used coolant with new coolant from a new fluid container, said first fluid transfer system including a first pump that pumps said substantial portion of used coolant from the engine to create a reduced pressure in the engine that sucks the new fluid into the radiator to replace said removed used coolant with new coolant, a second fluid transfer system that only operates when the engine is operational, said second fluid transfer system simultaneously displaces at least a substantial portion of used coolant in the engine with new coolant from the new fluid container and collects the displaced used coolant in the used fluid container, said second fluid transfer system including a second pump that pumps new coolant from the new fluid container into the engine, and a manually operable switch having a first position that enables operation of the first fluid transfer system and a second position that enables operation of the second fluid transfer system.

24. The machine according to claim 23 including a drain hose that establishes communication between the radiator and the used fluid container and a supply hose that establishes communication between the radiator and the new fluid container, said hoses being detachably connected to the radiator by quick connect-disconnect connector having one coupling component attached to a hose and another coupling component attached to radiator, said quick connect-disconnect connector upon being connected or disconnected substantially maintaining the reduced pressure in the engine.

25. A method of transferring coolant to and from an automotive engine having an engine cooling system including a radiator, said method comprising (a) providing a new fluid container holding new coolant and a used fluid container for holding used coolant from the engine, (b) providing a first fluid transfer system that sequentially first removes at least a substantial portion of used coolant from the engine and collects in the used fluid container the used coolant as said used coolant is being removed and then replaces said removed used coolant with new coolant from the new fluid container, said engine being non-operational when coolant is being transferred, (c) providing a second fluid transfer system that simultaneously displaces at least a substantial portion of used coolant in the engine with new coolant from the new fluid container and collects the displaced used coolant in the used fluid container, said engine being operational when coolant is being transferred, and (d) selecting one of said fluid transfer systems to transfer coolant based on the type of service to be provided.

26. A system for transferring coolant to and from an automotive engine having an engine cooling system including a radiator, said method comprising (a) a new fluid container holding new coolant and a used fluid container for holding used coolant from the engine, (b) a first fluid transfer system including means for sequentially first removing a portion of used coolant from the engine and collecting in the used fluid container the used coolant as said used coolant is being removed and then replacing said removed used coolant with new coolant from the new fluid container, said engine being non-operational when coolant is being transferred, (c) a second fluid transfer system including means for simultaneously displacing at least a substantial portion of used coolant in the engine with new coolant from the new fluid container and collecting the displaced used coolant in the used fluid container, said engine being operational when coolant is being transferred, and (d) means for selecting one of said fluid transfer systems to transfer coolant based on the type of service to be provided.

* * * * *

UNITED STATES PATENT AND TRADEMARK OFFICE

CERTIFICATE OF CORRECTION

PATENT NO. : 6,637,472 B2
DATED : October 28, 2003
INVENTOR(S) : Camacho et al.

It is certified that error appears in the above-identified patent and that said Letters Patent is hereby corrected as shown below:

Column 7,
Line 29, delete "MIKE, IS THIS TRUE?"

Column 10,
Line 24, "place" should be -- placed --
Line 50, delete one of the words "that"

Column 11,
Line 23, "dose" should be -- hose --

Signed and Sealed this

Thirteenth Day of July, 2004

JON W. DUDAS
*Acting Director of the United States Patent and Trademark Office*